US006708684B2

(12) United States Patent
Chattin

(10) Patent No.: US 6,708,684 B2
(45) Date of Patent: Mar. 23, 2004

(54) CABLE VIBRAGUARD

(75) Inventor: Jesse R. Chattin, Tampa, FL (US)

(73) Assignee: Vibraguard Corporation, Brandon, FL (US)

( * ) Notice: Subject to any disclaimer, the term of this patent is extended or adjusted under 35 U.S.C. 154(b) by 0 days.

(21) Appl. No.: 10/105,899

(22) Filed: Mar. 25, 2002

(65) Prior Publication Data

US 2003/0178017 A1 Sep. 25, 2003

(51) Int. Cl.[7] ..... F41B 5/10
(52) U.S. Cl. ..... 124/25.6
(58) Field of Search ..... 124/25.6, 86

(56) References Cited

U.S. PATENT DOCUMENTS 4,207,858 A * 6/1980 Blackstone
4,452,222 A * 6/1984 Quartino et al.
4,596,228 A * 6/1986 Smith
4,834,061 A * 5/1989 Chattin ..... 124/86
5,718,213 A * 2/1998 Gallops et al. ..... 124/25.6
6,425,385 B1 * 7/2002 Gallops ..... 124/25.6

* cited by examiner

*Primary Examiner*—John A. Ricci
(74) *Attorney, Agent, or Firm*—Pendorf & Cutliff

(57) ABSTRACT

The present invention concerns a cable guard for use with a compound bow, the compound bow having a handle portion and a pair of opposite bow limbs, a first and a second cable which cross one another in extending between opposite bow limbs and a bowstring, the cable guard comprising: a rod having a first end and a second end, wherein the first end of the rod is attach to the handle portion of the compound bow; a housing disposed at the second end of the rod; a pair of swing arms extending opposite to each other and outwardly from the housing in the direction of the bow limbs, the pair of swing arms pivotally connected about a point near one end of the housing; a biasing means in contact with the other end of the housing and the second end of the rod; and wherein when the bowstring is drawn to a draw position, the swing arms move in the direction of the bowstring moving the housing in the direction of the handle compressing the biasing means.

14 Claims, 6 Drawing Sheets

CABLE VIBRAGUARD

BACKGROUND OF THE INVENTION

1. Field of the Invention

This invention relates to a cable guard for a compound bow. More specifically, a cable guard that reduces the noise generated by the vibration of the cables, and at the same time, helps increase the speed of the arrow.

2. Description of the Related Art

In the sport of archery, the basic configuration and operation of compound bows are generally known as they have been in use for a long time. Compound bows are used a great deal in hunting, because they provide several distinct advantages. Compound bows mechanically reduce the maximum draw weight, allowing the archer to hold full draw at a draw weight less than that of the required maximum.

Compound bows also achieve more gradual arrow acceleration upon release with reduced stress on the arrow and the archer, which increases the arrow speed and shooting accuracy.

Compound archery bows include tension cables and a bowstring, which are connected between the upper and lower bow limbs. It is customary, in order to minimize any twisting torque on the bow limbs, to dispose the bowstring and the tension cables relatively close together, proximate the vertical centerline of the bow.

A problem presented by compound bows is that a noise is generated upon releasing the bowstring to propel the arrow. When the bowstring reaches the end of its arrow-propelling path, the cables which cross in the center portion of the bow rub against each, causing frictional forces that produce cable wear and create a noise or sound which may alert game birds and animals.

A popular solution to this problem is to provide compound bows with a cable guard having a rod mount which, by rotation of the mount, provides a selectable degree of displacement of the tension cable from the plane of the path of the bowstring. The rod mount is generally threaded directly into the bow handle area, either above or below the handgrip.

The prior art shows that numerous attempts have been made to maintain the lateral spacing of the cables and reduce the friction between the cables.

U.S. Pat. No. 4,452,222 entitled "Cable Guard for a Compound Bow" to Quartino et al. discloses a cable guard, which comprises a rod that extends from the bow handle and beyond the cables when the bow is in a fully drawn position. The rod is positioned laterally from the bowstring to void any interference with the bowstring. A cable-retaining member is rotatably and slidably mounted on the rod. The cable-retaining member includes two bores that are perpendicular to the rod for slidably receiving the cables to hold them in a lateral spaced relationship with the bowstring.

U.S. Pat. No. 4,596,228 entitled "Cable Separator for Compound Bows" to Smith discloses a rod attached to the handle portion of the bow that extends rearwardly beyond the bowstring. Positioned about the external surface of the rod is a cable guard assembly which positions a cable on either side of the bow. The purpose of the invention is to prevent an interfering contact of the cable strands with an arrow during impelling flight of the arrow from the bow, thereby obviating impairment of the true flight of the arrow released from the bow.

U.S. Pat. No. 5,718,213, entitled "Swing Arm Cable Guard" to Gallops Jr. et al., discloses a cable guard, including a support member and a swing arm pivotally connected thereto. A cable retaining means having two bores therein for retaining the cables is pivotally mounted on the swing arm. The angle between the support member and the swing arm is such that when the bow is drawn, the distance between the cables, which is contained in the cable retaining means, and the plane of the bowstring travel, is less than the distance between the cables and the plane of bowstring travel when the bow is at rest. Since the cables are closer to the plane of bowstring travel when the bow is drawn, the cables and bow limbs are less stressed when the bow is drawn. The cable guard retaining means may not be adjusted to change the distance between the cable guard retaining means and bowstring.

In prior art, cable guards of the type described above, the rod on which the retaining members were slidably mounted, was required to be of sufficient length to permit the retaining members to be mounted thereon when the bow was in the drawn condition.

Unfortunately, the rod length can be a potential distraction to the archer when the arrow is being shot. Another problem presented by the rod of the prior art is that most archers do not remove the cable guard from their bow for transport, and since many forms of transportation require bows to be cased for transport, the use of such cable guards requires substantial storage area and larger bow cases.

Further, the rod and sliding retainer introduces additional friction into the system, for example, the increased friction force between the cables and the sliding retainer and between the sliding retainer and the support rod as the bowstring is moved from brace position to full draw.

Some of these disadvantages appear to have been overcome by the cable guard disclosed in U.S. Pat. No. 4,834,061 entitled "Cable Vibraguard" to the present inventor, in which a support member has a swing arm pivotally attached thereto. A cable retaining member having two openings therein is located at the free end of the swing arm. The cables pass through and are contained within the openings of the retaining member. When the bow is drawn, the cables travel in a plane parallel to the general direction of the bowstring and cause the retaining member and connected swing arm to be pivoted away from the support member and the bow handle. The present invention is an improvement of the cable guard disclosed in this patent.

The present invention concerns another means for reducing the frictional forces between the cables and the bores of the retaining means.

Another problem presented by a conventional compound bow is that a considerable amount of energy stored in bow limb is wasted by propelling the bow limb forward when the drawn bowstring is released. Instead, it is desirable to use at least a portion of this wasted energy to propel an arrow.

The arrow speed depends upon several factors, one of the most important being the amount of energy put into the bow. Generally speaking, the more total energy put into the bow, the faster that the arrow will be propelled. Increased arrow speed is desirable, especially when hunting and shooting heavy arrows.

Another problem presented by a conventional compound bow is that the crossing cables are located in the point of view of the archer, thus the visibility of the archer is diminished.

Thus, the present inventor feels the necessity of providing a cable guard for a compound bow that is simple, quiet, inexpensive, and less susceptible to wear and tear, increases the visibility of the archer, and, at the same time, increases the arrow speed.

SUMMARY OF THE INVENTION

Therefore, it is an object of this invention to provide a cable guard that separates the cable positioned between the bowstring and the handle portion of a compound bow.

It is yet another object of the present invention to provide a cable guard that decreases the noise generated during the use as to not alert or frighten game birds and animals.

It is yet another object of the present invention to provide cable guard in which the frictional forces generated between the cables and the cable retaining members are reduced when the bow is drawn.

It is yet another object of the present invention to provide a cable guard which does not extend beyond the cables positioned between the bowstring and the handle portion of the compound bow.

It is yet another object of the present invention to provide cable guard with reduced hand shock and vibration in order to avoid arm fatigue.

It is yet another object of the present invention to provide a cable guard which is economical to produce and maintain.

It is yet another object of the present invention to provide a cable guard that separates the cable positioned between the bowstring and the handle portion of a compound bow increasing the visibility of the archer.

It is yet another object of the present invention to provide a cable guard that helps increase the speed of the arrow.

In view of the foregoing disadvantages inherent in the known types of security systems in the prior art, the present inventor discovered a unique cable guard for use with a compound bow, the compound bow having a handle portion and a pair of opposite bow limbs, a first and a second cable which cross one another in extending between opposite bow limbs and a bowstring, the cable guard comprising:

- a rod having a first end and a second end, wherein the first end of the rod is attach to the handle portion of the compound bow;
- a housing disposed at the second end of the rod;
- a pair of swing arms extending opposite to each other and outwardly from the housing in the direction of the bow limbs, the pair of swing arms pivotally connected about a point near one end of the housing;
- a biasing means in contact with the other end of the housing and the second end of the rod; and
- wherein when the bowstring is drawn to a draw position, the swing arms move in the direction of the bowstring moving the housing in the direction of the handle compressing the biasing means.

The cable guard further can include mounting means for attaching the first end of the rod to the handle portion of the compound bow; a biasing housing located near the second end of the housing, wherein the biasing housing comprises a center axis, wherein the second end of the rod runs through the center axis of the biasing housing; a pair of levers means, wherein each levers means is pivotally connected between the pivot point of the swing arm and the second end of the housing; and a cable guide means positioned at the first end of each swing arm, the cable guide means adapted slidably receiving and separating the first and second cable;

When the bowstring is drawn to a draw position, the cables move in the direction of the bowstring urging the swing arms in the direction of the bowstring. The movement of the swing arms moves the pair of lever means, and the movement the pair of lever means urges the biasing housing in the direction of the handle compressing the biasing means inside the biasing housing.

When the bowstring is release, the biasing housing moves back to it original position and the first and second cables are compelled to stop vibrating by the movement of the biasing housing returning to the original position thereby decreasing the amount of vibration noise produced by the vibrating of the first and the second cable.

The biasing housing includes a first portion and a second portion, wherein the diameter of the first portion is greater than the diameter of the second portion forming a seat.

The compression of the biasing means adds an extra tension force to the biasing means, and wherein the extra tension force provides the arrow with an increase speed.

In a first preferred embodiment, the biasing means comprises more than one spring.

Further, the present invention contemplates the use of an adjusting rod to engage the biasing means and change the pre-set compression force of the biasing means.

The foregoing has outlined rather broadly the more pertinent and important features of the present invention in order that the detailed description of the invention that follows may be better understood, and the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying other security systems for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several views of the drawings.

DETAILED DESCRIPTION OF THE INVENTION

Figure 1:
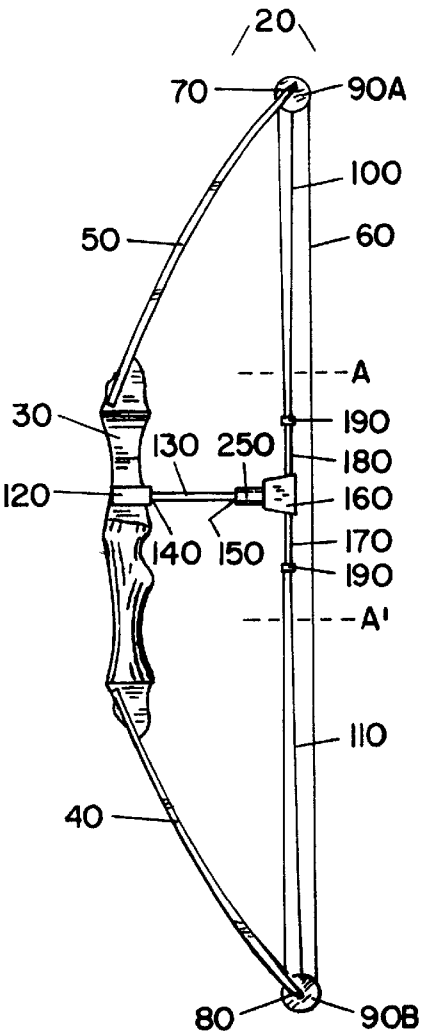
FIG. 1 is a side view illustrating the cable guard of the present invention attached to a compound bow in a rest position.

FIG. 1 is a side view illustrating the cable guard 10 of the present invention attached to a compound bow in a rest position. The cable guard 10 is used with a conventional compound bow 20 having a bow handle 30 and a pair of bow limbs 40, 50. The first bow limb 40 and the second bow limb 50 are oppositely positioned in bow handle 30. Bowstring 60 spans between a first bow tip 70 and a second bow tip 80. The bowstring 60 then continues and extends over the pulleys 90A, 90B positioned at or proximate to each of the bow tips 70, 80, and then the two ends of the bowstring 60, designated first cable end 100 and second cable end 110, cross to the opposite limb at which point they are attached to define a compound bow 20.

Figure 2:
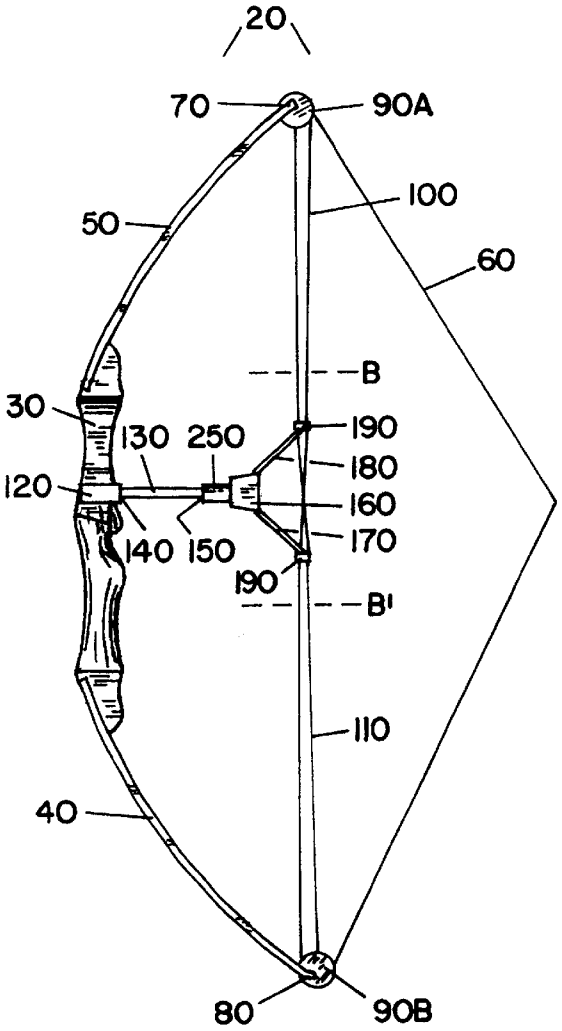
FIG. 2 is a side view illustrating the cable guard of the present invention attached to a compound bow in a drawn position.

FIG. 2 is a side view illustrating the cable guard of the present invention attached to a compound bow in a drawn position.

Figure 3:
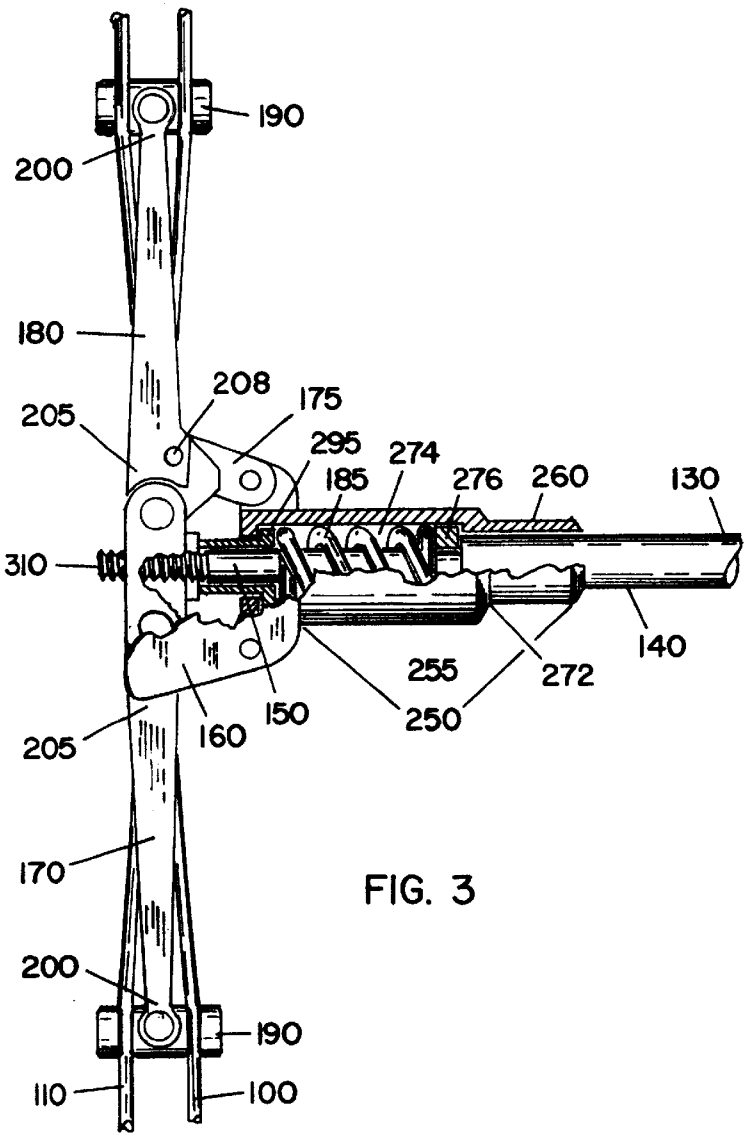
FIG. 3 is a partial section taken along line A–A[1] on FIG. 1.
Figure 4:
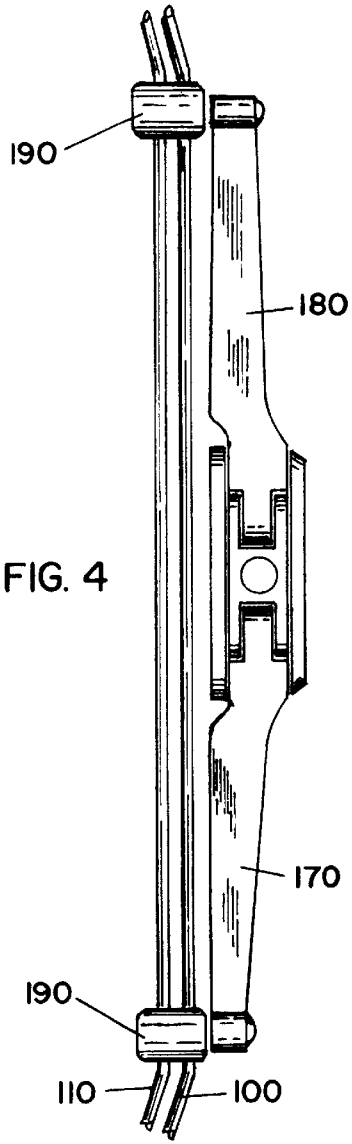
FIG. 4 is a rear view of FIG. 3.
Figure 5:
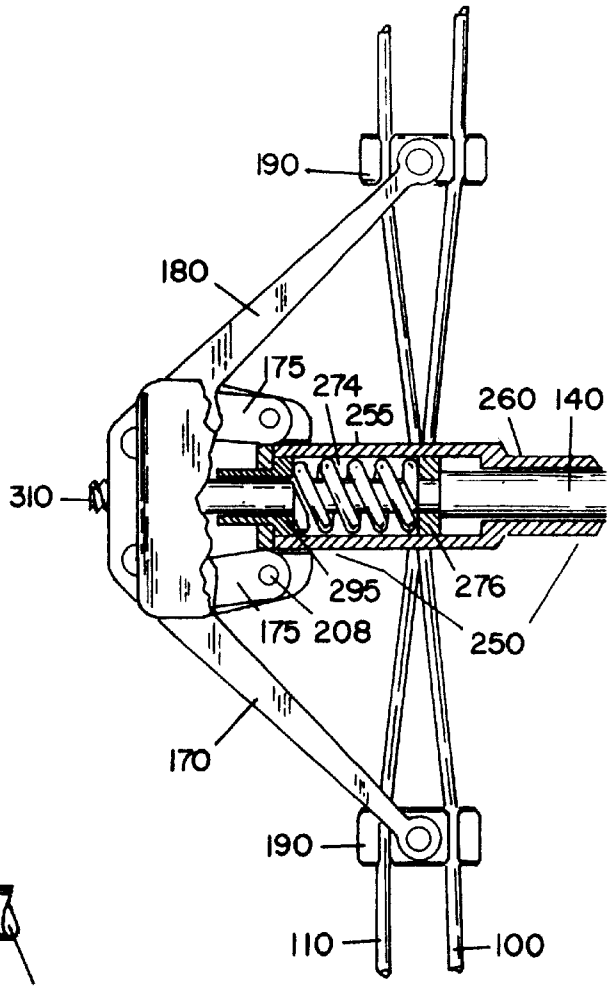
FIG. 5 is an enlarged side view of the present invention after the bowstring has been released.

FIG. 3 is a partial section taken along line A–A[1] on FIG. 1 and provides greater detail of the cable guard 10 of the present invention.

The cable guard 10 of the present invention includes a rod 130, a housing 160, and a biasing housing 250.

Rod

In its basic embodiment, the rod 130 includes a first end 140 and a second end 150. The first end 140 has a diameter greater than the diameter of the second end 150.

In a first preferred embodiment, the rod comprises a first section and a second section. The first section has a diameter greater than the diameter of the second section.

The first section includes an internal threaded end, and the second section includes an external threaded end. The external threaded end of the second section is threaded to the internal threaded end of the first section to form the rod.

The mounting means 120 firmly attaches the first end 140 of the rod 130 to the handle portion 30 of the compound bow 20.

Housing

A housing 160 is disposed at the second end 150 of the rod 130, the housing having a central axis, a first end, and a second end. The second end of the rod runs through the center axis of the housing;

The housing 160 includes a pair of swing arms 170, 180. Each arm includes a first end 200 and a second end 205, wherein the second end of each arm is pivotally connected about a point near the first end of the housing. The swing arms are connected to the housing 160 by using a fastening means such as floating pins 208.

A cable guide means 190 are positioned at the first end 200 of each swing arm 170, 180. Each cable retaining means 190 include openings 210 and 220 therein to retain cables 100 and 110. The opening 210 has a depth greater than the depth of the opening 220 in order to avoid that the cables touch and rub into each other.

The cable guide means 190 slidably receive and separate the first cable 100 and second cable 110. Thus, the first and second cable are slidably received and separated during the drawing and release of the bowstring 20, ensuring that the first cable 100 and second cable 110 do not rub against each other, and decreasing the amount of noise produced by the vibrations of the first 100 and second 110 cables immediately after the bowstring 20 has propelled an arrow.

Further, the housing includes a pair of lever means 175, wherein each lever means is pivotally connected between the pivot point of the swing arm and the second end of the housing.

The housing 160 further includes an internal stopper 215 to keep the housing means inside the housing.

Biasing Housing

The biasing housing 250 has generally tubular form and includes a first portion 255 and a second portion 260. The diameter of the first portion is greater than the diameter of the second portion, thus a seat 272 is formed.

The biasing housing 250 includes a borehole 274. The second end 150 of the rod 130 runs through the borehole 274 of the biasing housing 250 and the center axis of the housing 160. A first washer 276 is in contact with the seat 272 of the biasing housing 250.

A biasing means 185, such as a spring, is disposed inside the biasing housing 250. The biasing means 185 includes a first end 280 and a second end 290. The seat 272 confines the biasing means to first portion of the housing 250.

The second end 290 of the biasing means 185 is connected to a second washer 295, which is in direct contact with the internal stopper 215 of the housing 160.

The biasing means 185 is preferably a coil spring having a pre-set force. The coil spring is preferably made of steel, but can be made of any other suitable material.

The present invention contemplates also the use of any type of spring capable of storing power when compressed, such as an air spring, leaf spring, or other energy storage device as biasing means.

The biasing means 185 has an outer diameter slightly smaller than the inner diameter of the housing 250. The inner diameter of biasing means is slightly greater than the diameter of the second end 150 of the rod 130.

Figure 6:
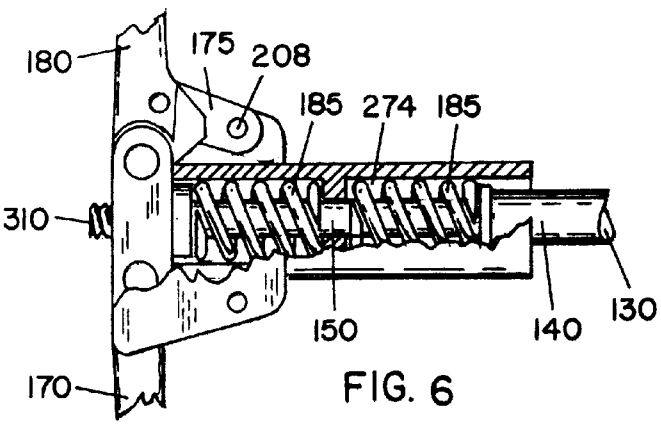
FIG. 6 is an enlarged side view showing the present invention having a biasing means comprising more than one biasing member.

The present invention also contemplates the use of a biasing means 185 comprising more than one spring. (FIG. 6)

The length of the biasing means depends on the type of compound bow used and is controlled to provide a "stopped" action of the swing arms, thus will not interfere with the discharged bowstring and arrow. Thus, when the biasing means goes back to its normal relaxed position, the biasing means provides the bow with an immediate stopping action that prevents any further movement of the swing arms or the cables.

Figure 7:
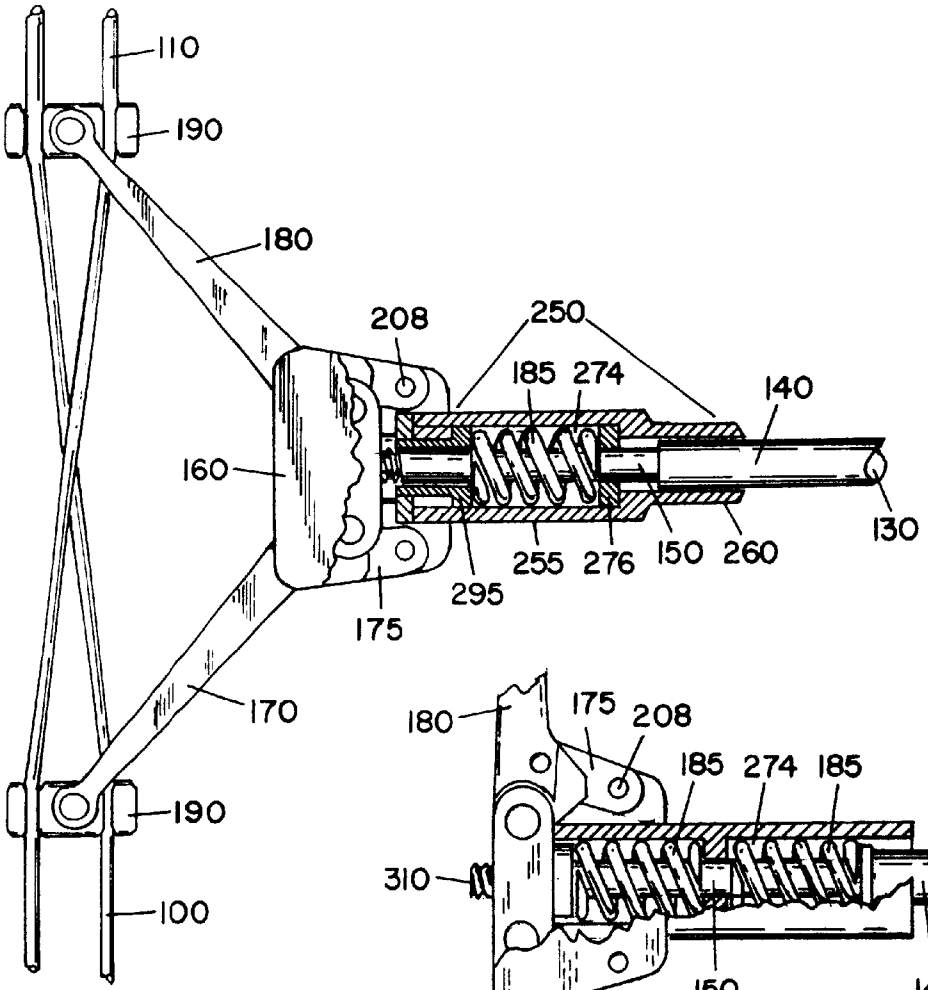
FIG. 7 is an enlarged side view of the present invention in a drawn position.
Figure 8:
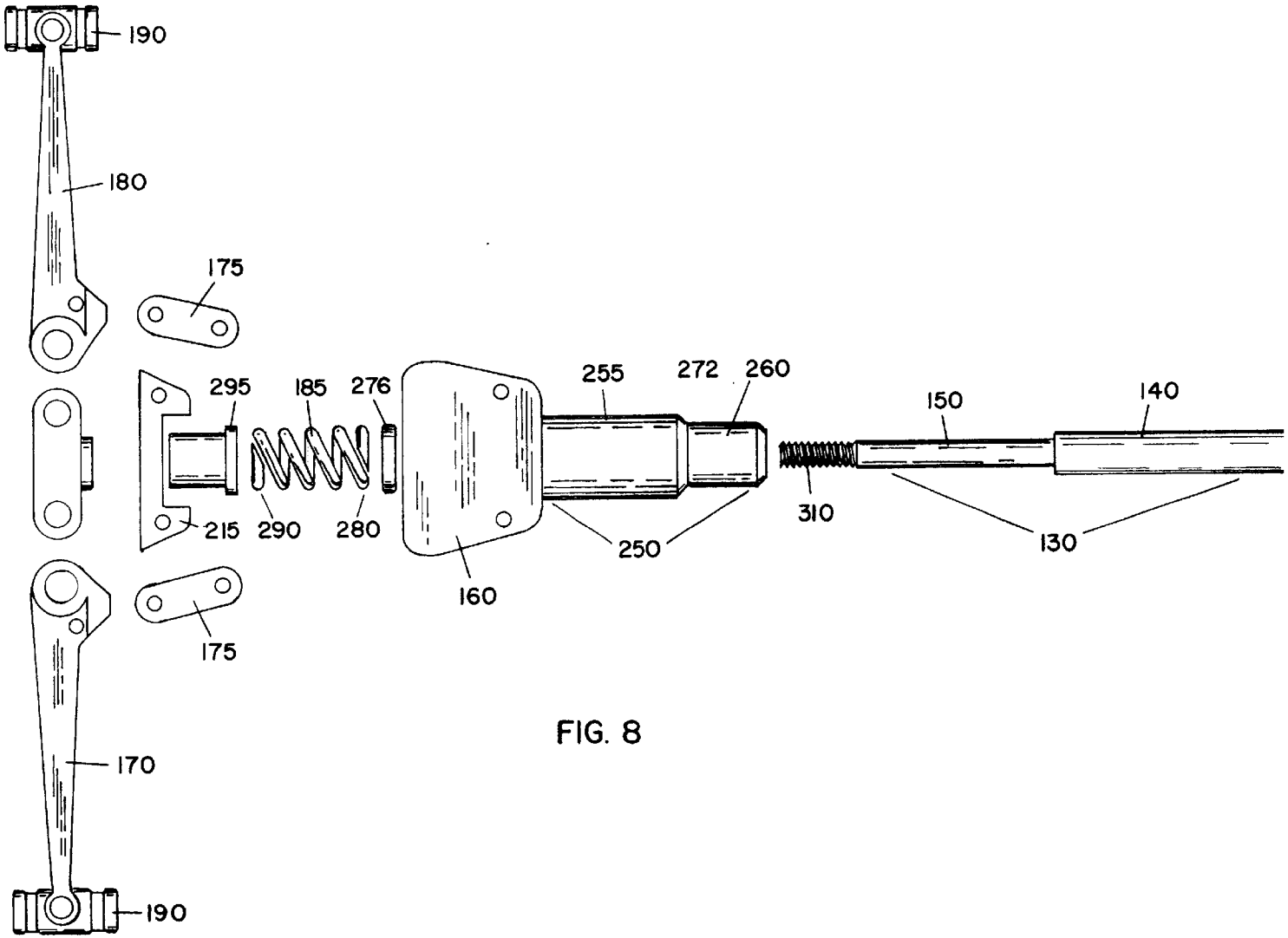
FIG. 8 is an exploded view of the cable guard of the present invention.

Optionally, the present invention contemplates the use of an adjusting rod 310 (FIG. 7) to engage the biasing means and change the pre-set compression force of the biasing means.

As can be seen from FIG. 1, rest position, the swing arms are substantially located in the same plane. In the drawn position, FIG. 3, the swing arms are diverging rearwardly to a substantially closed position. It will be seen that when bowstring 60 is drawn, cables 100 and 110 move in the direction of the bowstring and both cables retaining means 190 and swing arms 170, 180 are pivoted to the position shown in FIG. 2.

When the bowstring drawn to a draw position, the cables move in the direction of the bowstring urging the swing arms in the direction of the bowstring. The movement of the swing arms moves the pair of lever means, and the movement the pair of lever means urges the biasing housing in the direction of the handle compressing the biasing means inside the biasing housing.

The compression of the biasing means adds extra tension force to the biasing means. Thus, upon releasing the bowstring, the arrow is propelled by the pre-loaded tension of the biasing means, the extra tension on the biasing means, and, of course, also by the tension put into the bow by the final draw of the bowstring. The biasing means causes the energy that propels the arrow to be greater than the energy, which is required on the final draw of the bow. This improves the speed of the arrow.

Figure 9:
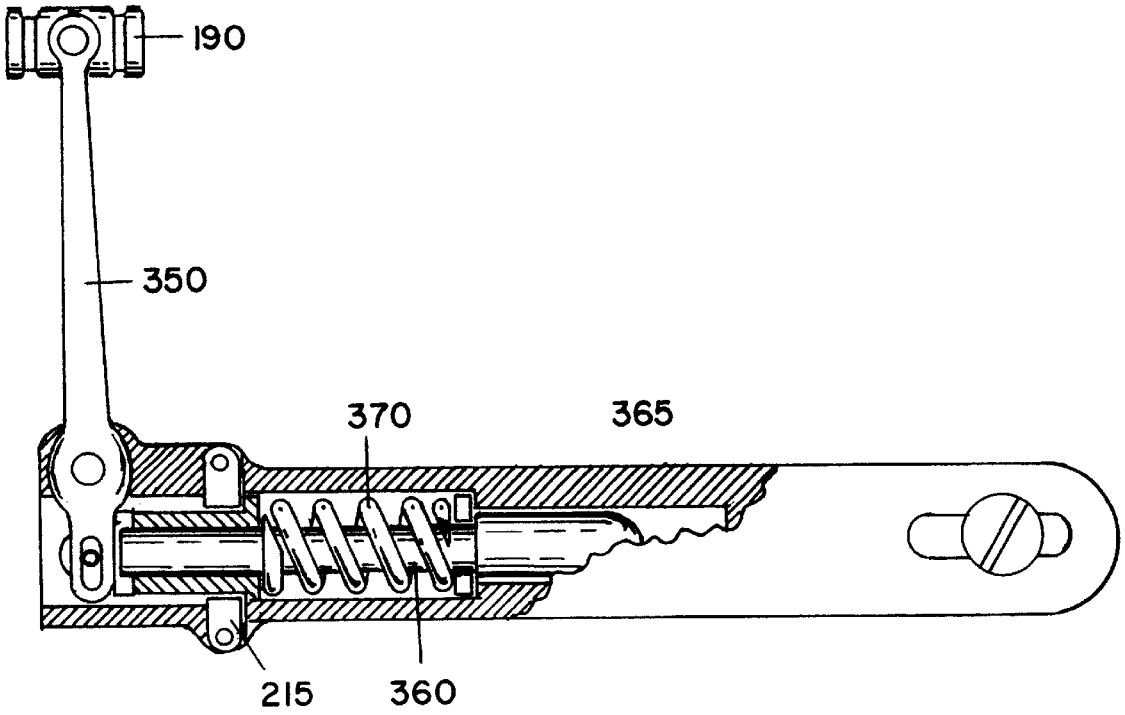
FIG. 9 is an enlarged side view of a single swing arm according to the first preferred embodiment of the present invention.
Figure 10A:
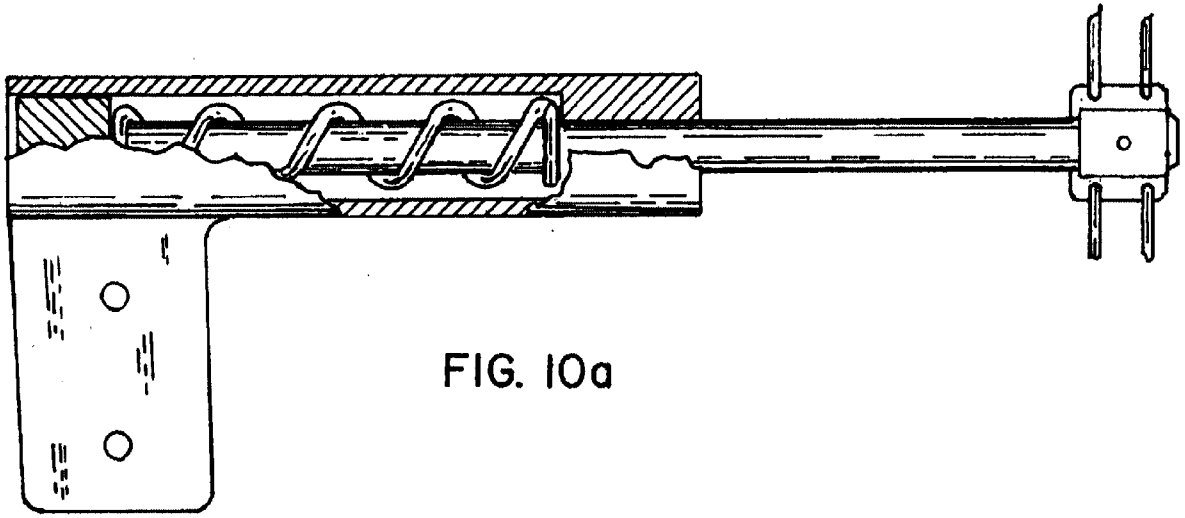
FIG. 10*a* is an enlarged side view of a single swing arm showing a leaf spring as biasing means.
Figure 10B:
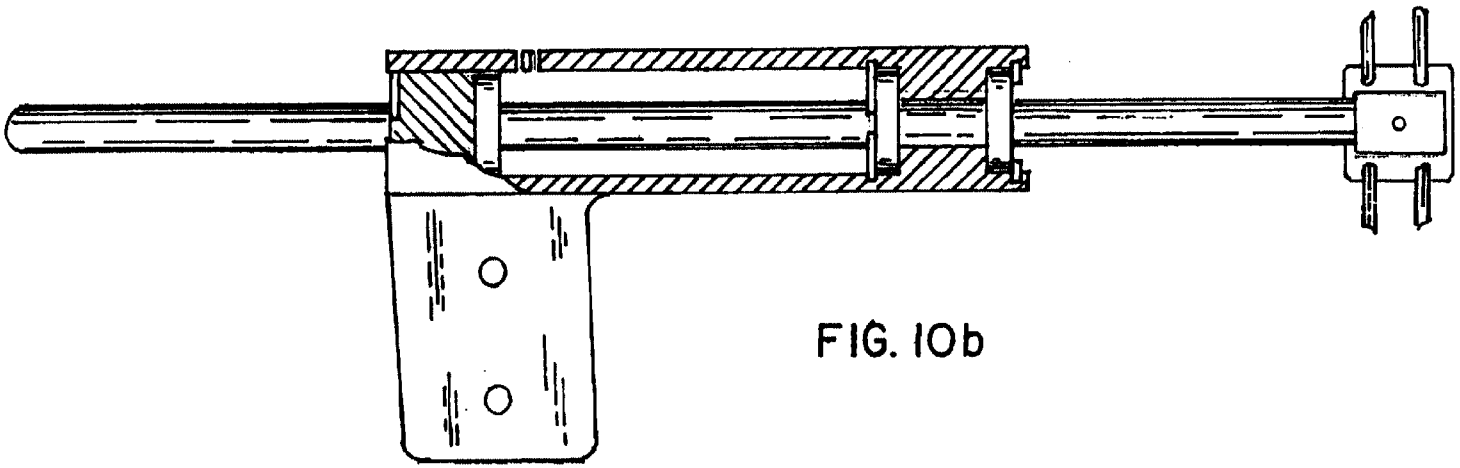
FIG. 10*b* is an enlarged side view of a single swing arm showing an air spring as biasing means.

In a first preferred embodiment, the cable guard of the present invention includes only one swing arm 350 (FIG. 9). The swing arm is attached to a rod 360, and the rod travels through the housing containing the biasing means 370. As the swing arm folds back, the rod travels forward compressing the biasing means. When the bowstring is released, the swing arm is pushed forward by the rod and the extra tension on the biasing means causing an increase in the speed of the arrow.

Thus, the cable guard of the present invention helps to overcome the problem presented by a conventional compound bow regarding the waste of energy produced by propelling the bow limb forward when drawn bowstring is released. Thus, the additional energy allows the user to use a lighter compound bow without loosing arrow speed or to shoot a bow that is more powerful than he is capable.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A cable guard for use with a compound bow, the compound bow having a handle portion and a pair of opposite bow limbs, a first and a second cable which cross one another in extending between opposite bow limbs and a bowstring, the cable guard comprising:

a rod having a first end and a second end, wherein the first end of the rod is attached to the handle portion of the compound bow;

a housing disposed at the second end of the rod;

a pair of swing arms extending opposite to each other and outwardly from the housing in the direction of the bow limbs, the pair of swing arms pivotally connected about a point near one end of the housing;

a biasing means in contact with the other end of the housing and the second end of the rod; and wherein when the bowstring is drawn to a draw position, the swing arms move in the direction of the bowstring moving the housing in the direction of the handle compressing the biasing means.

2. A cable guard for use with a compound bow, the compound bow having a handle portion and a pair of opposite bow limbs, a first and a second cable which cross one another in extending between opposite bow limbs and a bowstring, the cable guard comprising:

a rod having a first end and a second end;

mounting means for attaching the first end of the rod to the handle portion of the compound bow;

a housing disposed at the second end of the rod, the housing having a central axis, a first end, and a second end, wherein the second end of the rod runs through the center axis of the housing;

a pair of swing arms, wherein each arm includes a first end and a second end, wherein the second end of each arm is pivotally connected about a point near the first end of the housing;

a biasing means disposed inside a biasing housing located near the second end of the housing, wherein the biasing housing comprises a center axis, wherein the second end of the rod runs through the center axis of the biasing housing;

a pair of lever means, wherein each lever means is pivotally connected between the pivot point of the swing arm and the second end of the housing; and a cable guide means positioned at the first end of each swing arm, the cable guide means adapted for slidably receiving and separating the first and second cable;

wherein when the bowstring is drawn to a draw position, the cables move in the direction of the bowstring urging the swing arms in the direction of the bowstring;

wherein the movement of the swing arms moves the pair of lever means, wherein the movement of the pair of lever means urges the biasing housing in the direction of the handle compressing the biasing means inside the biasing housing.

3. The cable guard of claim 2, wherein when the bowstring is released, the biasing housing moves back to it original position and the first and second cables are compelled to stop vibrating by the movement of the biasing housing returning to the original position thereby decreasing the amount of vibration noise produced by the vibrating of the first and the second cable.

4. The cable guard of claim 2 wherein the biasing housing includes a first portion and a second portion, wherein the diameter of the first portion is greater than the diameter of the second portion forming a seat.

5. The cable guard of claim 2 wherein the biasing means is elected from the group consisting of coil spring, air spring, and leaf spring.

6. The cable guard of claim 2 wherein the biasing means comprises at least one spring.

7. The cable guard of claim 2 further comprising an adjusting rod adapted to engage the biasing means and change a pre-set compression force of the biasing means.

8. The cable guard of claim 2 wherein the compression of the biasing means adds an extra tension force to the biasing means, and wherein the extra tension force provides the arrow with an increased speed.

9. The cable guard of claim 2 wherein the guide means includes a first and a second opening formed therethrough.

10. The cable guard of claim 9 wherein the depth of the first opening is greater than the depth of the second opening to avoid that the cables touch each other.

11. The cable guard of claim 2 wherein the rod comprises a first section and a second section, wherein the first section has a diameter greater than a diameter of the second section, wherein the first section includes an internal threaded end and the second section includes an external threaded end, wherein the external threaded end of the second section is threaded to the internal threaded end of the first section.

12. The cable guard of claim 2 wherein the first end of the rod has a diameter greater than a diameter of the second end of the rod forming a seat.

13. The cable guard of claim 2 wherein the housing further comprises an internal stopper located at the second end of the housing.

14. A cable guard for use with a compound bow, the compound bow having a handle portion and a pair of opposite bow limbs, a first and a second cable which cross one another in extending between opposite bow limbs and a bowstring, the cable guard comprising:

a rod having a first end and a second end, wherein the first end of the rod is attached to the handle portion of the compound bow;

a swing arm attached to the second end of the rod, a biasing means disposed inside a housing, wherein the housing comprises a center axis, wherein the second end of the rod runs through the center axis of the housing;

wherein when the bowstring is drawn to a draw position, the swing arm folds back moving forward the rod compressing the biasing means.

* * * * *